US005372365A

United States Patent [19]

McTeigue et al.

[11] Patent Number: 5,372,365

[45] Date of Patent: Dec. 13, 1994

[54] METHODS AND APPARATUS FOR SPORTS TRAINING

[75] Inventors: Michael H. McTeigue, Mountain View; Art Zias, Los Altos, both of Calif.

[73] Assignee: SportSense, Inc., Mountain View, Calif.

[21] Appl. No.: 974,563

[22] Filed: Nov. 12, 1992

Related U.S. Application Data

[63] Continuation-in-part of Ser. No. 644,084, Jan. 22, 1991, Pat. No. 5,221,088.

[51] Int. Cl.[5] ..... A63B 69/36

[52] U.S. Cl. ..... 273/187.2; 434/252; 434/253; 73/379.02; 273/187 R; 273/81 R; 273/187.5

[58] Field of Search ..... 273/187 R, 187 B, 188 R, 273/188 A, 189 R, 189 A, 190 R, 190 C, 183 B, 183 D, 186 R, 186 E, 440, 193 R, 81 R, 81.2, 81.4; 340/323 R; 128/25 B; 177/210 C, 200, 199; 482/52, 7, 74; 73/379-381; 434/252, 253, 392

[56] References Cited

U.S. PATENT DOCUMENTS

| | | | |
|---|---|---|---|
| 1,530,519 | 3/1925 | Remington | 273/188 R |
| 2,626,151 | 1/1953 | Jenks | 273/190 R |
| 3,169,022 | 2/1965 | Kretsinger | 273/187.2 |
| 3,352,559 | 11/1967 | Larsen | 273/195 R |
| 3,397,892 | 8/1968 | Stahl | 273/190 R |
| 3,413,006 | 11/1968 | Beston | 273/187 R |
| 3,670,574 | 6/1972 | Edwards | 273/187.2 |
| 3,792,863 | 2/1974 | Evans | 273/186.2 |
| 3,897,058 | 7/1975 | Koch | 73/379.02 |
| 3,994,501 | 11/1976 | O'Donnell | 273/187.1 |
| 4,304,406 | 12/1981 | Cromarty | 273/187 R |
| 4,318,546 | 3/1982 | Chen | 273/188 R |
| 4,326,718 | 4/1982 | Kiehl | 273/187 R |
| 4,337,049 | 6/1982 | Connelly | 434/247 |
| 4,502,035 | 2/1985 | Obenauf et al. | 340/323 B |
| 4,516,110 | 5/1985 | Overmyer | 434/253 |
| 4,527,982 | 7/1985 | Salzman et al. | 434/258 |
| 4,560,166 | 12/1985 | Emerson | 273/187.2 |
| 4,577,868 | 3/1986 | Kiyonaga | 273/187.1 |
| 4,662,640 | 5/1987 | Grander | 273/187.2 |
| 4,861,034 | 8/1989 | Lee | 273/81.2 |
| 4,869,509 | 9/1989 | Lee | 273/187.2 |
| 4,930,785 | 6/1990 | Mills | 273/194 R |
| 5,049,079 | 9/1991 | Furtado et al. | 434/253 |
| 5,118,112 | 6/1992 | Bregman et al. | 434/252 |
| 5,221,088 | 6/1993 | McTeigue et al. | 273/81 R |

FOREIGN PATENT DOCUMENTS

| | | |
|---|---|---|
| 0275665 | 7/1988 | European Pat. Off. . |
| 2626483 | 11/1988 | France . |
| 2221767 | 11/1973 | Germany . |

OTHER PUBLICATIONS

"Biofeedback and Sports Science"; Edited by Jack H. Sandweiss and Steven L. Wolf; Plenum Press; Publication Date unknown; pp. 20–23 and 174–177.

Advertisement: Golf Shop Operations; Reader Service No. 102, p. 80; J-PAR Golf Company advertisement (Ad #J-PAR 1244).

*Primary Examiner*—Vincent Millin
*Assistant Examiner*—Steven B. Wong
*Attorney, Agent, or Firm*—Timothy H. P. Richardson

[57] ABSTRACT

A method and apparatus for training a user to move in a desired movement pattern, especially for training a golfer to swing a golf club. One or more sensors are placed adjacent the user, for example pressure sensors under the user's feet and/or between the user's hands and a golf club. The sensors generate signals corresponding to the user's movement. A comparator and signal generator are used to compare a function of the user signals and a reference value, and to generate training signals which are communicated to the user, e.g. by radio frequency signals received by a headset worn by the user. In this way, the user senses, during the actual movement, training signals which represent a relationship between the actual movement pattern and a desired movement pattern. Preferably, the comparator determines whether a function of the user signals is above or below a preselected and adjustable reference value, and the training signals undergo a distinct change when the function of the user signals crosses the reference value.

14 Claims, 9 Drawing Sheets

METHODS AND APPARATUS FOR SPORTS TRAINING

CROSS-REFERENCE TO RELATED APPLICATION

This application is a continuation-in-part of copending commonly assigned application Ser. No. 07/644,084 filed Jan. 22, 1991 now Pat. No. 5,221,888, and copending commonly assigned International Application No. PCF/US92/00533 filed Jan. 22, 1992, the entire disclosure of which is incorporated herein by reference.

BACKGROUND OF THE INVENTION

1. Field of the Invention

This invention relates to methods and apparatus for sports training.

2. Introduction to the Invention

Many methods have been proposed for training people to improve theft skills in sporting activities. However, the known methods suffer from serious disadvantages. For example, they make use of intrusive equipment and/or methods which are distracting or impossible to use during normal play; and/or do not provide immediate information to the player; and/or do not provide information in a form which the player can easily understand and act upon; and/or cannot be adjusted to reflect important variables, in particular the skill level of the player.

SUMMARY OF THE INVENTION

We have discovered, in accordance with the invention, that excellent training results can be obtained, and the above disadvantages overcome, by novel methods which comprise (1) placing a sensor at a preselected location adjacent to the user, which sensor, when the user moves in an actual movement pattern similar to the desired movement pattern, can (i) sense changes in a user factor which are characteristic of the actual movement pattern and (ii) generate user signals corresponding to said changes;

(2) placing a comparator at a location where a function of the user signals generated by the sensor can be communicated to the comparator, which comparator, when the user moves in an actual movement pattern, can make a comparison between a function of the user signals and a reference value;

(3) placing a signal generator at a location where (i) results of the comparison made by the comparator can be communicated to the signal generator, and (ii) signals generated by the signal generator can be communicated to the user, (4) causing the user to move in an actual movement pattern similar to the desired movement pattern;

(5) causing the sensor to generate user signals which correspond to changes in the user factor sensed by the sensor;

(6) communicating a function of the user signals to the comparator;

(7) causing the comparator to make a comparison between a function of the user signals and the reference value;

(8) communicating the results of the comparison made by the comparator to the signal generator;

(9) causing the signal generator to generate training signals which represent the results of the comparison made in step (8); and

(10) communicating the training signals to the user;

steps (4) to (10) being carried out substantially simultaneously, so that the user senses, during the actual movement pattern, training signals which represent a relationship between the actual movement pattern and the desired movement pattern. The training signals can for example be constant "reinforcing" signals which show that the movement complies with a preselected criterion, e.g. falls within a desired range (including a range having a maximum but no minimum, or a minimum but no maximum); or constant "fault" signals which show that the movement fails to comply with a preselected criterion; or varying signals which tell the user how far the movement departs from a preselected criterion; or a combination of reinforcing, fault, and varying signals.

The invention also includes novel apparatus for carrying out the method defined above, the apparatus comprising (1) a sensor which, when the apparatus is in use, (a) is placed at a preselected location adjacent to the user, and (b) when the user moves in an actual movement pattern similar to the desired movement pattern, immediately generates a user signal which is characteristic of the actual movement pattern;

(2) a comparator which, when the apparatus is in use, immediately makes a comparison between a function of the user signal and a reference value; and (3) a signal generator which, when the apparatus is in use, immediately generates a training signal which is immediately communicated to the user and thus immediately informs the user of a relationship between the actual movement pattern and the desired movement pattern.

Preferred features of the invention include the following characteristics A to L (A) (i) the comparator determines whether a function of the user signals is above or below a preselected and adjustable reference value, and (ii) the training signals undergo a distinct change when said function of the user signals crosses the reference value;

(B) (i) the user signals change continuously in response to changes in the user factor, (ii) the comparator determines whether a function of the user signals is above or below a preselected reference value, and (iii) the training signals undergo a distinct change when said function of the user signals crosses the reference value;

(C) the method comprises the steps of:

causing the user to adopt a desired starting position prior to step (4), causing the signal generator to generate a starting signal after the user has adopted the desired starting position, and ensuring that the signal generator does not generate training signals before expiry of a preselected delay period after the starting signal;

(D) (i) the method makes use of two spaced-apart sensors, each of which generates distinct user signals, (ii) the comparator compares a function of each of the distinct user signals with a respective reference value, (iii) the signal generator generates distinct training signals which represent the results of the respective comparisons, and (iv) the distinct training signals are communicated separately to the user;

(E) (i) the method makes use of two spaced-apart sensors, each of which generates distinct user signals, and (ii) the comparator makes a comparison between a function of one of the distinct user signals and a reference value which is a function of the other distinct user signals;

(F) the reference value is a function of the user signals at an earlier time during the actual movement;

(G) (i) the method makes use of a single sensor which is placed under one of the user's feet and senses the force applied to said single sensor by the user's weight, and (ii) the training signal represents the results of comparing a function of the user signals generated by said single sensor and a reference value;

(H) (i) the method makes use of two spaced-apart sensors, (ii) one of the sensors is placed under a first part of one of the user's feet and senses the force applied to said sensor by a first part of the user's foot, and (iii) the other sensor is placed under a second part of the same one of the user's feet and senses the force applied to said other sensor by a second part of the user's foot;

(I) (i) the sensor is placed between a substrate and at least one of user's hands, and senses a value related to the grip pressure applied by the user to the substrate, and (ii) the user signals change continuously in response to changes in the grip pressure;

(J) (i) the sensor is placed between a substrate and at least one of the user's hands, and senses the grip pressure applied by the user to the substrate, and (ii) the reference value is a function of the maximum grip pressure which the use can apply to the substrate;

(K) (i) the sensor is one which can be calibrated relative to a fixed point, direction or plane and which, after being so calibrated, can generate user signals which represent the relationship between the sensor and the fixed point, direction or plane; and (ii) the sensor is calibrated relative to a fixed point, direction or plane before steps (4), (5), (6), (7), (8), (9) and (10); and (L) the sensor, the comparator and the signal generator, and any other equipment needed to carry out the method, are carried by the user during the actual movement pattern.

The invention is useful in a wide variety of activities, in particular those in which the user's performance depends upon the forces generated by the user's mass on the ground or floor, and/or the forces generated by the user's hands on a substrate, and/or the position of a part of the user's body, e.g. torso or head, as the desired movement is carried out. Such activities include sports in which an object, usually a ball, is thrown or kicked by the user or is struck by a club, racket or other piece of sports equipment which the user grips and swings, e.g. golf, tennis, baseball, football, basketball, baseball and bowling, and throwing the discus, javelin or weight. The invention is also useful for training users for other track and field activities, including starting routines for track events, particularly sprints, and for training users in the correct use of stationary exercise machines. The user is usually a human being, but may also be another trainable animal.

An important advantage of the invention is that it provides the user with real time feedback as to the relationship between his actual movement pattern and the desired movement pattern and, immediately thereafter, between his actual movement pattern and the result achieved, e.g. in a sports activity whether a ball has been struck in the desired way. Furthermore, this can be done without making use of a trainer and/or during normal conduct of the sporting activity. Real-time feedback has been found to be a key element in teaching the "muscle-memory" which enables a trained user to consistently follow an effective movement pattern.

BRIEF DESCRIPTION OF THE DRAWINGS

The invention is illustrated in the accompanying drawings, in which.

DETAILED DESCRIPTION OF THE INVENTION

Figure 1:
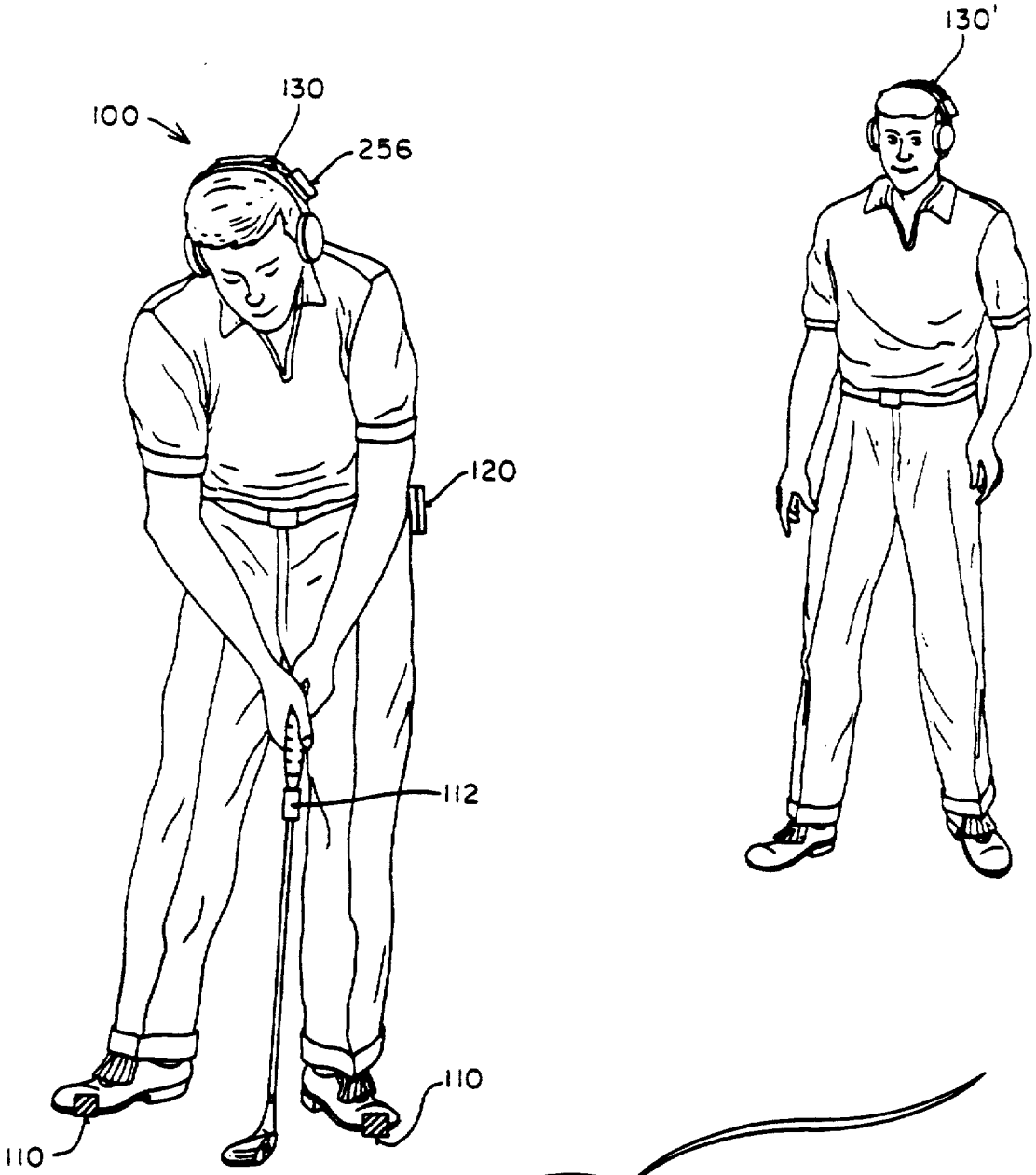
FIG. 1 shows a user who is being trained to swing a golf club with the aid of weight and grip sensors.

In the following detailed description of the invention, the user is often designated as a male. This is merely in the interests of brevity and convenience. The invention is equally applicable to female users.

In one preferred embodiment, the training signals undergo a distinct change when a function of the user signals crosses a reference value. When there is a single reference value, the function of the user signals is thus compared with a preselected range which (a) runs from zero to a maximum which is the reference value, or (b) runs from a minimum which is the reference value to infinity. When there are two reference values, the function of the user signals is compared with a preselected range whose limits are set by those reference values. At a limit of the range, the training signals undergo a distinct change, for example a change from a first fixed signal, preferably an audio signal, to a second fixed signal, preferably an audio signal of distinctly different frequency and/or volume. One of the signals can be the absence of anything sensed by the user, for example, silence. Thus the training signal can for example be a high volume high frequency audio signal if the function of the user signals is above a desired preselected range, a low volume medium frequency signal if it is within the range, and a high volume low frequency signal if it is below the range. The training signals can, but preferably do not, also change within and/or outside the range so as to indicate the extent to which the actual movement differs from the limits set by the range, or from some preselected value within the range.

We have found that a user can learn much more readily from simple training signals of this kind, which merely tell him whether the movement is within an acceptable range, than he can from varying training signals which tell him how far the actual movement differs from the desired movement. We have also found that even better results can be obtained if the range is not only preselected, but also adjustable. In this way, the range can be adjusted to reflect variables, in particular the skill level and physique of the user, as well as other variables such as weather conditions, or terrain, e.g. the slope of the ground. Very flexible and rapid training can be achieved in this way, in particular by adjusting the preselected range to reflect the user's improved skills as training progresses.

Many different user factors can be monitored by the sensor. Particularly valuable user factors include (1) the force exerted by the user on a substrate, e.g. on the ground (or floor), or on the handle of a swingable object, and (2) the angle between a part of the user's body, e.g. spine, head or shoulders, and a preselected direction or plane. The sensor preferably monitors a single user factor and generates user signals, throughout at least a distinct part of the movement, in such a way that the training signals can be (though they are not necessarily) sensed by the user as substantially continuous. The training signals can for example be generated over only a small proportion (e.g. 10–30%) of the total time, but frequently enough that they are sensed continuously by the user. Such intermittent signals can be the result of correspondingly intermittent user signals or correspondingly intermittent operation of the comparator. It is also possible to provide electronic smoothing of signals which would otherwise not be sensed by the user as continuous signals. When the training signals change only when a function of the user signals crosses a reference signal, the user signals need not in theory be generated except in the vicinity of the change; however, it will usually be convenient for the user signals to be generated substantially continuously.

One or more sensors can be used. Two or more sensors can be used simultaneously or sequentially during all or part of a single movement pattern. It is also possible for the user to choose which of two or more sensors is (or are) activated during all or part of a particular movement pattern. When two or more sensors are used, they are usually spaced apart from each other, and can be of the same or different types.

Especially when the movement can be divided into two or more distinct parts, e.g. the backswing and the downswing in a golf shot, a particular sensor can generate user signals during one part and not at all during another part of the movement. In this way, for example, a first sensor can be used to generate training signals relating to a first user factor during a first part of the movement and a second sensor can be used to generate training signals relating to a second user factor during a second part of the movement. The selected function of the user signals from a single sensor can be the same throughout the movement. Alternatively, different functions of the same user signals can be compared (either substantially simultaneously or sequentially during different parts of the movement) with respective reference values which can be the same or different. When different functions of the same user signals, or functions of the user signals from two or more sensors, are used to generate distinct and substantially simultaneous training signals, it is of course necessary for the training signals to be sensed separately by the user. This can be done for example by different audio signals which may be communicated to the left and right ears of the user, preferably corresponding to user factors related to the left and right sides of the user's body, e.g. left and right feet or arms. This can also be done, but is not necessary, when two or more training signals are used at different times during the movement.

Any function of the user signals can be communicated to the comparator and the same or a different function can be compared with a reference value. For example the comparison can be made with the signals themselves, or a multiple thereof, or a differential thereof, or an integral thereof over a short period, or the sum of or difference between two different functions of the same user signals, or a more complex function. When there are two or more sensors, the comparison can be made with a function obtained by merging functions of the different user signals, e.g. by adding one to the other, or subtracting one from the other. When different functions of the same user signals are compared separately with a reference value, the respective reference values can be the same or different. Similarly, when functions of user signals from different sensors are compared separately with a reference value, the respective reference values can be the same or different.

As briefly indicated above, it is often useful to monitor changes in the forces which the user's weight applies to the ground (or floor) through one or both of the user's feet, as the user moves. Accordingly, in one preferred embodiment, at least one pressure sensor is placed between one or both of the user's feet and the ground or floor, so that it senses the force applied to the sensor by the user's weight. That force depends upon not only the proportion of the user's weight which is applied to the sensor, but also on the acceleration forces ("g forces") of the user's body, i.e. on the way in which the user is moving. Such a sensor can sense all of the force applied to a single foot by the user, or merely that part of the force which is applied to a distinct part of a single foot, for example the ball, arch or heel of the foot. The foot can be the right foot or the left foot. When the sensor senses all of the force applied to a single foot by the user, and the user's total weight is known, then an approximate measure of the force applied to the other foot can be obtained by subtraction; however, the measure is only approximate for a rapid movement, because it ignores the g forces. This embodiment is particularly useful when the user adopts a fixed stance prior to, and during at least part of, a movement in which the user swings a swingable object, e.g. a golf club, a baseball bat, or a tennis racket. The foot can be the leading foot or the trailing foot depending on the user's stance, which will often vary between right-handed and left-handed users.

The sensor is preferably part of a thin pad which can be used as a shoe insert with little or no modification of the user's conventional shoe for the sporting activity in question. Thus the pad is preferably one that can be trimmed to shape, is comfortable and moisture-resistant, and provides a non-slip surface. However, the sensor can also form part of an attachment to the outside of the user's shoe, or form part of a pad which is placed on the ground (or floor) where the user will stand.

Specific examples of this preferred embodiment include (a) the use of a single sensor, with the training signal representing the results of comparing a function of the user signals generated by that single sensor and a reference value; (b) the use of two spaced-apart sensors, one under a first pan of one of the user's feet and the other under a second part of the same foot; and (c) the use of two spaced-apart sensors, one under each of the user's feet. In this embodiment, the reference value preferably is (a) a function of the user's weight, as determined in a separate test carried out under static conditions prior to the actual movement, or (b) a function of the maximum force exerted on the sensor, or the respective sensor, by the user during a separate dynamic test carried out prior to the actual movement.

As also briefly indicated above, it is also often useful to monitor changes in the force or forces applied by one or both of a user's hands on a substrate, e.g. a swingable object such as a golf club, tennis racket or baseball bat. Such forces are often referred to as "grip" or "grip pressure". Accordingly, in another preferred embodiment, at least one sensor is placed between a substrate and one or both of the user's hands, and senses a value related to the user's grip pressure on the substrate. There can be a single sensor which senses a value related to the grip pressure applied (a) by all or a selected part of the user's right hand, or (b) by all or a selected part of the user's left hand, or (c) by all or selected parts of both of the user's hands together. Alternatively there can be two sensors, one sensing a value related to the grip pressure applied by all or a selected part of the user's right hand and the other sensing the grip pressure applied by all or a selected part of the user's left hand. In this embodiment, the reference value is preferably a function of the maximum grip pressure which the user can exert, through all or a selected part or parts of one or both hands, on the sensor, or on the respective sensor, in a separate test carried out prior to the actual movement, the separate test usually being carried out under static conditions. The grip pressure sensor is preferably in the form of a thin pad or tape which can be (a) secured to the handle of the swingable object, or (b) placed within or on a user's glove, or (c) incorporated into the glove itself, and which preferably makes little or no difference to the way in which the user grips the handle.

Grip pressure sensors suitable for use in these embodiments of the invention are readily available. A preferred sensor comprises flexible electrodes and, sandwiched between the electrodes, a thin layer of a resistive material whose resistivity changes as it is compressed. The electrodes are preferably thin metal strips or films which are secured to flexible polymeric films, preferably by screen printing or otherwise metallizing a desired electrode pattern onto a polymeric film. The resistive material is preferably a layer of conductive polymer or a resistive ink which is screen printed or otherwise deposited in a desired pattern on top of one or both of the electrodes before the plastic films are brought together to sandwich the resistive layer between the electrodes. The resistive layer may be for example 10 to 30 microns thick, and the total thickness of the laminate about 0.015 inch to 0.025 inch (about 0.03 to 0.06 cm). The thickness of the laminate decreases by only a small amount under pressure, e.g. by about 0.001 inch (0.0025 era) under a pressure of 200 psi (14 kg/cm$^2$). Such change is not directly perceived by the user. Such products are often referred to as force sensitive resistors. One such product is available from Techscan Corp. of Boston, Mass., USA, under the trade name FSR. The user signal generated by such a sensor is a resistance which varies with the compressive force applied to all or part of the electrodes. A somewhat similar pressure sensor comprises two flexible sheet electrodes which are separated by a layer of a compressible dielectric. The user signal generated by such a sensor is a capacitance which varies with the compressive force applied to all or part of the electrodes. Such sensors are allowable in any desired shape, e.g. a tape to be wrapped around the handle of a swingable object, or a shape approximating to the whole or part of the bottom of a user's foot. The pressure sensor itself is generally sandwiched between one or more layers of an insulating material, e.g. a polymeric film, which may extend substantially beyond the sensor itself so as to provide an assembly which can be conveniently secured in place with the sensor at a desired location, e.g. an inner sole for a shoe with the sensor under the ball of the user's foot.

Another known pressure sensor makes use of a flexible pressure vessel and a piezo resistive pressure transducer. Another makes use of an appropriately shaped spring and a switch which functions as a position encoder for the spring.

In another embodiment, the sensor can be calibrated relative to a fixed point, direction or plane and, after being so calibrated (in a separate step carried out prior to the actual movement), can generate user signals which represent the relationship between the orientation of the sensor and the fixed point, direction or plane. Such a sensor is typically used to monitor the way in which the user changes the position of a part of his body, usually his torso and/or his head, during the actual movement.

In one aspect of this embodiment, an inclinometer is attached to the user's back and generates a user signal which is characteristic of the angle between the user's spine and the vertical or between the user's spine and a plane on which the user is standing, e.g. a horizontal plane. The inclinometer is preferably a unidirectional accelerometer with its sensing axis parallel to the user's spine and set up to act as a variable impedance inclinometer. The gravitational acceleration sensed by the inclinometer is (g.cos $\theta$) where $\theta$ is the angle of spinal tilt and g is the vertical gravitational acceleration.

In another aspect of this embodiment, two inclinometers, preferably unidirectional accelerometers, are attached to the user, e.g. to a hat or headband on the user's head, with their sensing axes in a preselected relation, preferably at right angles to each other and parallel to the ground, for example with one of the sensing axes pointing directly ahead when the user is in a preliminary stance with his body and neck free from twist. The outputs of the inclinometers can be are processed separately, or one can be used to normalize the other, to obtain a signal which is characteristic of the movement of part of the user's body.

In another aspect of this embodiment, an angular displacement sensor is attached to the user's back, preferably slightly below the shoulder line, and monitors the angle between a line joining the user's shoulders during the movement and a line joining the user's shoulders when the user is in a preliminary stance with his body free from twist. Preferably the angular displacement sensor comprises two bidirectional accelerometers which are placed a fixed distance apart on or near the user's shoulder. The sensing axes of the accelerometers are parallel to each other and to the ground and point directly ahead when the user is in a preliminary stance with his body free from twist. The outputs from the accelerometers are combined and the resulting signal is double integrated over a specific interval of time to provide a signal which is characteristic of the angular displacement of the user's shoulders. This is particularly useful for monitoring the angle between the user's shoulders and the direction in which a ball is to be thrown or hit by means of a swingable object.

The comparator compares one or more functions of the user signals with one or more reference values. The results of two or more different comparisons can be combined in any desired way through the use of appropriate logic gates. The reference value(s) can be constant. Alternatively, it can vary in a known way during the movement, for example (a) as a function of a variable such as the time elapsed from a particular moment, e.g. the time when a part of the user's body, or a piece of equipment held by or attached to the user, begins to move or passes a reference point (e.g. the vertical or the horizontal), or (b) as a function of user signals generated by the same sensor at an earlier time or by another sensor. In either case, the reference value(s) can be selected by the user or a trainer, for example on the basis of results in a static or dynamic test carried out by the user before the actual movement. Alternatively the reference value(s) can be built into the apparatus, for example in apparatus which is sold in a number of different versions for users of different physiques and/or skill levels. The reference value(s) can be functions of particular "ideal" values derived from the movement patterns of particularly skilful sportsmen or sportswomen. Thus the user or his trainer may select apparatus which incorporates fixed reference values derived from analysis of the movement of a well known performer, or may select adjustable reference values on the basis of such analysis, the selection being based on the user's and/or the trainer's personal preferences and/or the physique of the user.

The results of the comparison(s) made by the comparator are communicated to a signal generator. The signal generator generates training signals which are immediately communicated to the user. Audible training signals are preferred, but other types of signals are possible, e.g. visual, electrical or tactile. Training signals can also be communicated simultaneously to a person other than the user, e.g. a trainer, and/or can be recorded. Training signals which are communicated to another person or which are recorded can be the same as or different from those communicated to the user. For example, when the training signals change only when a function of the user signals crosses a reference value, more complex training signals can be communicated to another person and/or can be recorded. Such more complex training signals can for example show the extent to which the function of the user signals differs from an ideal signal during the movement. The more complex signal can be used for more detailed after-the-fact analysis of the user's actual movement, for example to see whether and how the preselected range should be changed to most effectively train the user.

In many circumstances, it is desirable for the user to know that the apparatus is ready for use before the actual movement is started. For this purpose, the signal generator can generate a characteristic alert signal when the apparatus is ready for use.

It is also often desirable that training signals should not be generated until the user has adopted a desired starting position, or until the movement has progressed to a particular stage. On the other hand, it is desirable that the user should know, at some earlier stage, that the apparatus is ready for use. It is, therefore, preferred that the user or another person should be able to switch the apparatus on; that the signal generator should then generate a starting signal which is sensed by the user (and which may continue thereafter); and that after a preselected delay period, or when the movement has progressed to a particular stage, but not before, the signal generator should generate training signals and, optionally a short signal that the active period has begun.

It is also often desirable that the apparatus should automatically switch itself off (a) after a preselected period of time from the time it was switched on, and/or (b) if no user signals are generated over a preselected period of time.

Although the invention can be used as part of a training program supervised by a trainer, it is particularly valuable when it can alternatively or additionally be used by the user for training himself, especially during the normal conduct of a sporting activity. It is preferred, therefore, that the sensor, the comparator and the signal generator, and any other equipment needed for carrying out the method, should be carried by the user during the actual movement.

Any convenient method can be used to communicate the user signals, the results of the comparison made by the comparator, and the training signals. They can be transmitted, for example in the form of analogue or digital signals, by means of radio frequency or other electromagnetic wave, e.g. infra-red or ultrasonic, transmitters and receivers, or by means of electrical conductors or fiber optic links. They may be encoded to show their origin and/or their address. When radio transmission is employed, it is preferably strong enough for the receiver to receive the signal reliably, but weak enough not to interfere with other transmissions and thus require regulatory approval, e.g. a transmission range of 3 to 5 meters. Especially when the transmitter is battery-powered, as it will be in the preferred portable apparatus, it can operate on a shortened duty cycle, e.g. 25%, to reduce power consumption. Preferably it is possible to select one of at least two frequencies so that any interfering signals can be avoided. A typical frequency is 27 Mhertz. When a radio transmitter is used, it can transmit a continuous intermittent signal from a single sensor or from the combined outputs of two or more sensors, or it can send intermittent signals which are distinguishable front each other (e.g. because they are of different frequencies) from two (or more) sensors. Typically, a radio transmitter will generate a signal having a pulse width which is related to the output of a sensor to which it is linked. The pulse width is typically 0.3 to 6.0 milliseconds and the pulse repetition rate about 7 milliseconds. The transmitter is secured to a convenient location, e.g. to the user's shoe, to a swingable object gripped by the user, or to a harness strapped to the user.

The comparator compares a function of the user signals to at least one reference value. When more than one sensor is used to generate sensor signals which are compared separately with a reference signal, separate comparators (or separate comparison circuits) may be used, or the comparator may make separate comparisons sequentially over very short periods of time in order to generate separate comparisons. When the user can select different sensors prior to the movement, separate comparators may be used. Alternatively, the user may program the comparator so that it is effective for the selected sensor(s) and corresponding reference value(s). Similar considerations apply to the signal generator.

Comparators and signal generators suitable for use in this invention are well known and do not require detailed general description here. Particular apparatus which we have used is described in connection with accompanying drawings.

When, as is preferred, the apparatus is to be portable by the user, it is often convenient for all the necessary components, except the sensors and their associated wireless transmitters or other communication links, and the headset, if one is used, to be placed within a single container, or a limited number of containers, which can be secured to a belt or harness worn by the user. Such a container might for example contain the comparator, the signal generator, batteries to power the apparatus, switches, means for calibrating the sensors, and means for selecting the reference value(s).

The invention is of particular value for teaching a golfer (this term being used of course to include enabling a golfer to teach himself) how to swing a golf club. In developing this invention, we have made a number of important discoveries which are set out below and which, in conjunction with the methods and apparatus already described, enable a golfer to acquire golfing skills at a greatly improved rate.

We have discovered that when a golfer is standing on level ground, e.g. at a tee, the force exerted on his front foot (left foot for a right-handed golfer) should be relatively low during the backswing, and relatively high during the downswing, i.e. up to the time that the ball is hit. This is contrary to the opinion held by many that it is desirable that a golfer's weight should be equally distributed between his feet throughout the stroke. We have also discovered that improved results are obtained if, during the downswing, a relatively high proportion of the user's weight, preferably at least 60%, particularly at least 65%, especially at least 70%, even as high as 90%, is borne by the ball and the heel of the front foot. In general, the more skilful the golfer, the higher the percentage of his weight that he places on his front foot. During the early part of the downswing, the golfer's weight is preferably mainly on the ball of his front foot, and during the final part of the downswing, his weight is preferably mainly on the heel of his front foot. Relatively poor results are obtained if a substantial amount of pressure is exerted on the leading edge of the front foot (an area including the little toe and the adjacent outside area of the left foot of a right-handed golfer) rather than on the ball and heel of the front foot as described above.

Four specific examples for implementing these discoveries are given below.

(A) A single sensor is placed under the front foot, preferably under the ball and the heel only of the front foot; a reference value corresponding to at least 60%, e.g. about 65%, 70%, 75%, 80%, 85% or 90%, preferably about 70%, 75%, or 80% of the user's weight is used; and the system is arranged so that the golfer knows when, during his downswing, the pressure exerted on his front foot exceeds the level represented by that reference value. For example, the training signal can be an audio signal which is communicated to the golfer only when the desired pressure is exceeded, in which case the golfer attempts to generate that signal as early as possible during the downswing, and to keep it on until he has hit the ball.

(B) The method described in (A) above gives excellent results with golfers who are relatively skilful, but is less successful with golfers who have a low level of skill. Unskilled golfers are apt to roll their weight onto the leading edge of the front foot, and thus to turn off the training signal (when the sensor is not under that part of the foot). This tends to confuse the golfer. With unskilled golfers, we have obtained better results by placing a single sensor under the rear foot (the right foot for a right-handed golfer), preferably under the whole of the rear foot; calculating a user signal which represents the weight borne by the front foot and which is equal to the user's weight minus the weight applied to the sensor, comparing that user signal with a reference value which corresponds to at least 60%, e.g. about 65%, 70%, or 75%, preferably about 70%, of the golfer's weight; and arranging the system so that the golfer knows (preferably by an audio signal) when the weight borne by his front foot exceeds the level represented by the reference value. Thus the golfer attempts, during his downswing, to generate that signal as early as possible, and to keep it on until he has hit the ball.

The same information can be communicated to the golfer by using complementary values for the user signal and/or the reference value, i.e. by using the output of the sensor itself as the user signal; comparing the user signal with a reference value which corresponds to at most 40%, e.g. about 35%, 30%, or 25%, of the golfer's weight; and arranging the system so that the golfer knows when the weight borne by his rear foot is less than the level represented by the reference value.

(C) In a method which is similar to (B) above, but in which the golfer also receives training signals about his weight distribution during the backswing, a single sensor is placed under the rear (right) foot; a first user signal corresponding to the pressure applied to the sensor is obtained; a second user signal corresponding to the user's total weight minus the weight applied to the first sensor is calculated (this represents the weight applied to the front foot); the first user signal is compared to a first reference value corresponding to at least 60%, e.g. about 65%, 70% or 75%, preferably about 70%, of the user's weight; the second user signal is compared to a second reference value corresponding to at least 60%, e.g. about 65%, 70% or 75%, preferably about 75%, of the user's weight; and the system is arranged so that the golfer knows (a) when the pressure exerted on his rear foot exceeds the level represented by the first reference value (preferably by an audio signal communicated only to his right ear), and (b) when the second user signal exceeds the level represented by the second reference value (preferably by an audio signal communicated only to his left ear). Thus the golfer attempts, during his backswing, to generate a first training signal (e.g. in his right ear) indicating that his rear foot is carrying a major percentage of his weight; and then attempts, during his downswing, to generate as quickly as possible a second training signal (e.g. in his left ear), indicating that a major percentage of his weight has been transferred to his front foot, and to keep that second signal on until he has hit the ball.

As in method (B), the same information can be communicated to the golfer by using complementary values for the user signals and/or the reference values.

(D) In a method which is similar to (A) above, but in Which the golfer also receives training signals about his weight distribution during the backswing, the output from a single sensor placed under the front foot is processed in a way analogous to that used in method (C) above.

(E) A shoe insert is placed under the golfer's front foot. The insert comprises three separate sensors, the first at the ball of the foot, the second at the heel of the foot and the third at the leading edge of the foot.

In one series of tests using this shoe insert, only the third sensor is used; its output is compared to a reference value which corresponds to about 25%, 30%, 35%, 40%, or 45%, preferably 35%, of the golfer's weight; and the golfer is given a signal, preferably an audio signal, if the reference value is exceeded. The golfer attempts to maintain his weight distribution such that no audio signal is generated until the ball has been hit.

In another series of tests using this shoe insert, only the first and second sensors are used, and during the early part of the downswing, their outputs are compared with reference values in two different ways. In one comparison, the sum of the two outputs is compared to a first reference value representing at least 60%, e.g. about 65%, 70%, 75%, or 80%, preferably about 70%, of the user's total weight. In the other comparison, the output from the second sensor is subtracted from the output of the first sensor, and the result is compared to a reference value representing at least about 30%, e.g. 40%, of the user's total output. A training signal is communicated to the golfer only if (a) the sum of the two outputs exceeds the first reference value and (b) the difference between the first and second outputs exceeds the second reference value. Thus the golfer receives a training signal only if he distributes his weight not only mainly on the front foot, but also mainly on the ball of his front foot, during the early part of the downswing. Preferably, as the downswing continues, the reference values are changed progressively so that the training signal is generated only if the golfer not only keeps his weight mainly on his front foot, but also gradually transfers his weight from the ball of his front foot to the heel of his front foot at the time he hits the ball.

Training arrangements and routines of still greater sophistication can be employed. For example, the control unit can be programmed with one or more profiles relating the weight placed on a specific zone of a golfer's foot as a function of time. Consider the time/weight profile of the left foot. During the downswing, both the amounts and the locations of weight home on the left foot vary according to a prescribed pattern. This pattern can be related to the timing of the downswing, using the start of downswing, time of impact with the ball and completion of followthrough as time reference points. This information can be formulated into a time/-weight profile for one or more zones of the foot. The weight shift of a trainee golfer during his downswing can be compared to an expert's profile during the expert's downswing. A tolerance band, consistent with the player's skill level, is preselected, thereby establishing an allowed degree of deviation from the expert's profile. When the player performs within that tolerance band, he receives a reinforcing training signal, but when he performs outside the tolerance band, he receives a different training signal, i.e. a "fault tone". As the skill of the player increases, the tolerance band can be narrowed, thereby training the golfer to perform in closer conformance to the expert's profile.

We have also found that when a golfer swings a golf club, the pressure (force) which his hands exert on the golf club has an important influence on his swing. The following findings relate to a right-handed golfer, but are applicable to a left-handed golfer if the right and left hands are reversed in the following descriptions.

We have found that if the left hand grips the club too strongly, this is disadvantageous; for example, it delays muscular response at the beginning of the downswing and tends to lock the left wrist. We have also found that the best measure of the grip of the left hand is the pressure exerted on the club by the three fingers furthest from the thumb. Accordingly it is useful to monitor the pressure exerted by these three fingers on the club and to give the golfer a fault signal if the pressure becomes excessive, e.g. more than 15% or 20% as he addresses the ball, 30% or 40% at the beginning of the downswing, and 60% just before he hits the ball, these percentages being based on the maximum pressure which the golfer can exert on the club through these three fingers in a preliminary test.

It has also been found that improved results are obtained if the grip of the right hand is applied mainly by the fingers, particularly the tips of the two middle fingers, rather than by the thumb and index finger. Accordingly it is useful to monitor the pressure exerted on the club by the tips of the two middle fingers of the right hand and to give the player a fault signal if the pressure falls below a preselected value, preferably a preselected percentage, e.g. 40%, of the maximum pressure which the golfer can exert on the club in this way in a preliminary test. Alternatively or additionally it is useful to monitor the pressure exerted on the club by the thumb and index finger and to give the golfer a fault signal if the pressure rises above a preselected value, preferably a preselected percentage, e.g. 40%, of the maximum pressure which the golfer can exert on the club in th is way in a preliminary test.

It has also been found that it is desirable that the golfer's grip should remain constant during the swing. Thus it is desirable that, in the procedures just described, the golfer should also be notified, by means of one training signal, if the pressure exerted by the left hand falls below a certain level, e.g. 15% of the maximum pressure which the golfer can exert with his left hand, and, by means of another training signal, if the pressure exerted by the right hand rises above a certain level, e.g. 60% of the maximum pressure which the golfer can exert with his right hand.

It has also been found that it is disadvantageous for a golfer to try to accelerate the clubhead by pushing out on the club with the right hand and/or pushing in with the left hand. Accordingly it is useful to place sensors at at least one of the points where such pressures would be exerted, and to generate appropriate training signals to the user.

As with the weight sensors, so also with the grip sensors, the reference value(s) used by the comparator can be derived from the "ideal" movement of a highly skilled athlete.

With regard to the position of the golfer's body, we have found that the golfer should incline his spine forward at an angle of about 10 to about 30, preferably 20–30, degrees to the vertical when addressing the ball, and should maintain that angle substantially constant during the backswing and downswing. We have also found that the golfer's shoulders should rotate between 85 and 100 degrees during the backswing. Through the use of inclinometers or the like in accordance with the present invention, as described above, a golfer can learn to achieve these objectives.

The invention is illustrated in the accompanying drawings. The drawings and the detailed description thereof refer to particular individual features, and particular combinations of individual features, as applied to a male right-handed golfer who is learning to swing a driver as he stands on level ground. It is to be understood that, where the context permits, the invention includes other combinations of such individual features and variations of such features, and combinations which are appropriate to a person of either sex who is right-handed or left-handed, or who is learning to swing a golf club other than a driver, or who is not standing on level ground, or who is learning a sport other than golf.

Figure 5:
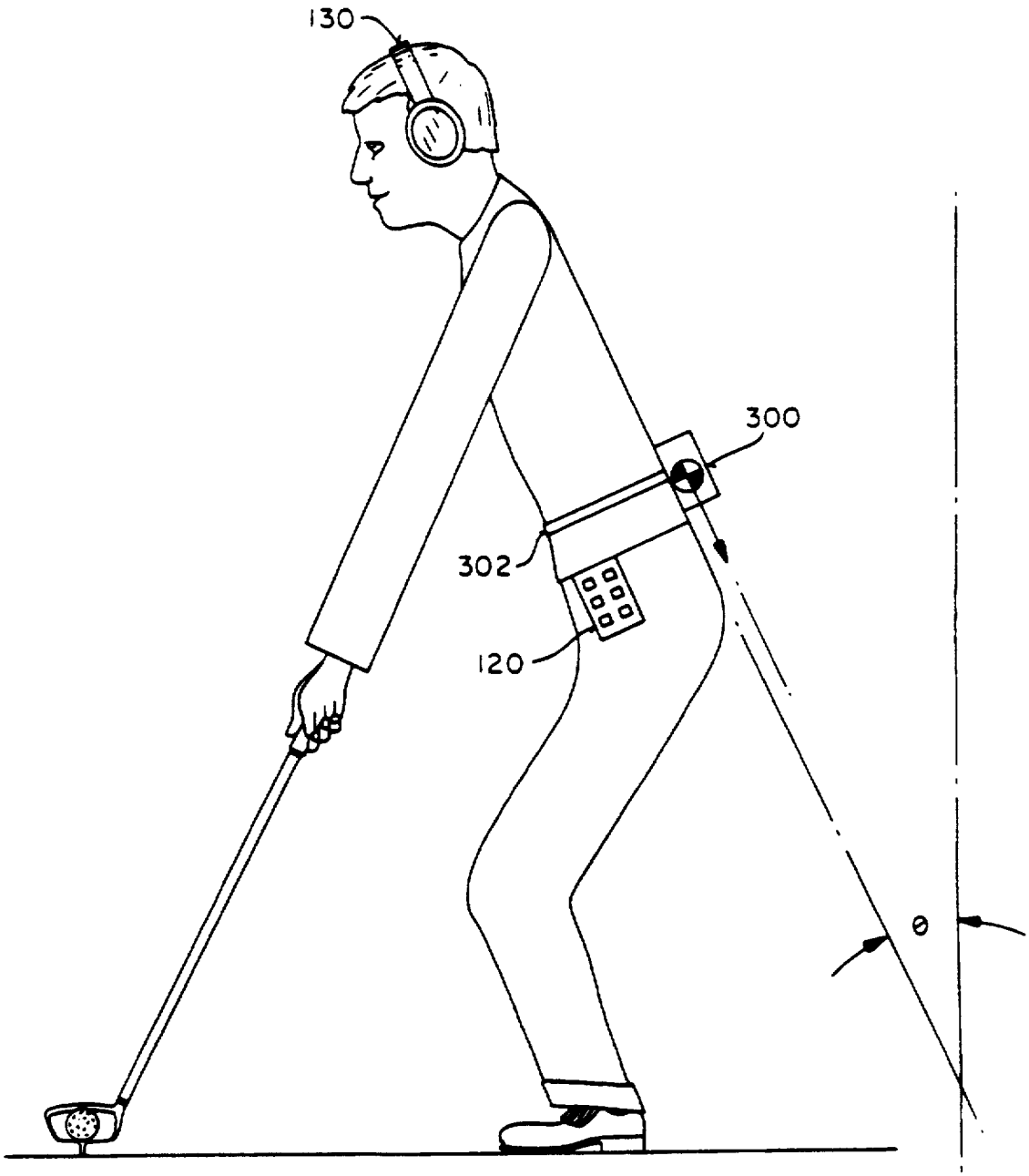
FIG. 5 shows a user who is being trained to swing a golf club with the aid of a spine tilt sensor.
Figure 6:
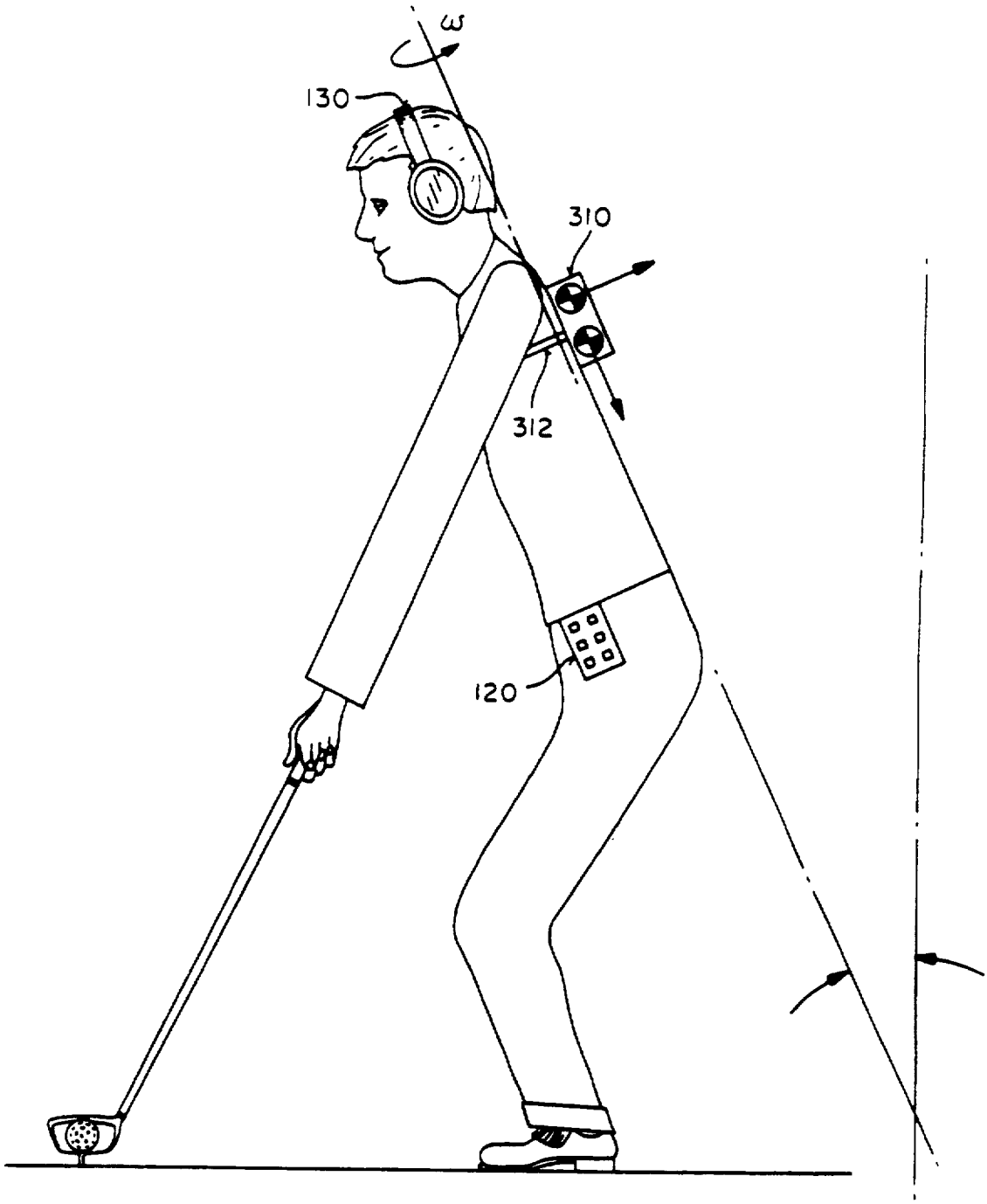
FIG. 6 shows a user who is being trained to swing a golf club with the aid of a shoulder rotation sensor.

Referring now to FIGS. 1 to 4, these show a golfer who is learning to swing a golf club, and associated apparatus. Shoe inserts 114 containing pressure sensors 110 are placed in the shoes of a golfer 100 who is holding a golf club, the sensors preferably being under the balls of the golfer's feet. Associated with each sensor 110 is a battery-powered encoder/transmitter 140 which reads the impedance of that sensor and transmits a radio frequency (RF) signal which is a function of that impedance. Attached to the handle of the golf club is a pressure sensor 112 and an associated battery-powered encoder/transmitter 142 which reads the impedance of that sensor and transmits an RF signal which is a function of that impedance. Attached to the golfer's head is a battery-powered stereo headset 130 which includes left and right headphones 252 and 254 and RF receiver 256. Attached to the golfer's belt is a battery-powered control unit 120, which functions as a comparator and a training signal generator. As discussed below, the control unit is used to implement a training program which makes use of signals generated by pressure sensors as shown in FIG. 1 and/or inclinometers or the like as shown in FIGS. 5 and 6. The control unit comprises a microprocesser (CPU) 160, a nonvolatile memory 162 such as a ROM or EPROM which stores software; a volatile random access memory 164 for temporary storage of parameters, user selections, etc; a user interface 170 which comprises a start/stop key 174, a scan key 176, threshold control keys 180 and 182, volume control keys 190 and 194, and a liquid crystal display 172 for displaying various user prompts, values and the like; an RF receiver/decoder 210 which receives and decodes RF signals from the transmitter/encoders 140; memory registers 212 and 214; attenuators 184 and 186; a set of mode switches 220; comparators 222 and 224; and RF transmitter 250.

In broad terms, the apparatus is operated as follows. The control unit is first calibrated by means of calibration signals generated in turn by the different sensors in preliminary tests. The calibration signals are encoded and transmitted to the control unit, and after being received and decoded, are stored in the memory registers. The reference signals are derived from the stored calibration signals via attenuators, which are controlled by the golfer via the user interface. The golfer selects the desired reference values and program for the control unit. He then carries out his movement. Signals are sent to the control unit by the sensor(s) selected by the program; the signals are processed by the control unit; and functions of them are compared with the appropriate reference values; the results of the comparison are transmitted to the headset and communicated to the golfer. Further details are given below.

When the Scan Key 176 is depressed, the control unit scans an appropriate band of frequencies (e.g., 8 to 9 KHz) for signals being transmitted to the control unit by transmitters 140 and 142. An error message is displayed on LCD 172 if signals are received from less than the programmed number of transmitters, for example due to battery failure.

Threshold control keys 180 and 182 set threshold values which can be displayed on the LCD and which can be increased or decreased by use of the up and down portions of each key. For the weight sensors 110, the control keys set minimum threshold values, expressed as a percentage of the golfer's weight, for the weight on the golfer's right and left feet, respectively. For example, the threshold controls can be both set to 75%, in which case a first audio signal will be generated if the golfer puts more than 75% of his weight on his right foot, and a second audio signal will be generated if the golfer puts more than 75% of his weight on his left foot. For the grip sensor 112, the control keys set minimum and maximum acceptable pressures, expressed as a percentage of the golfer's maximum grip. For example, the controls can be set at 35% and 65%, in which case a first fault tone will be generated if the grip pressure is below 35% and a second fault tone will be generated if the grip pressure is above 65%.

Before the golfer can begin training, the control unit must be calibrated. The golfer puts all his weight first on one of the sensors 110 and then on the other sensor 110, and he grips the sensor 112 as hard as he can. The resulting signals are sent by transmitters 140, 142 to receiver 210 and stored in memory registers 212 and 214. The golfer then uses the control keys 180 and 182 to change the attenuators 184 and 186 and thus select desired reference values.

The control unit 120 also comprises volume control keys 190 and 194 which control the volume of audio signals sent to the left and right earphones of the headset 130. These keys also have secondary functions which are accessed when the UP and DOWN portions of the key are simultaneously depressed for one second or more. The UP and DOWN portions of key 194 can then be used to select between the programmable functions shown in Table 1 below, and the LIP and DOWN portions of key 190 can be used to set the values of these functions. The selectable values can be scrolled up or down by holding the UP or DOWN portions of key 190 depressed. After five seconds of inactivity, the keys revert to their volume control function. The programmed values are retained in memory 164 until reprogrammed or until the device's battery is disconnected.

The programmable functions, their default functions, and their selectable values are shown in Table 1 below.

TABLE 1

| FUNCTION | DEFAULT | SELECTABLE VALUES |
|---|---|---|
| MODE | Weight Shift | Grip, Weight Shift, Spine, Tilt, Shoulder Rotation, Grip/W. Shift, Spine Title/W. Shift |
| ON DELAY | Zero | 0 to 99 seconds |
| ON TIME | Always On | 5 to 99 seconds and ON |
| LEFT TONE | 1.0 KHz | 0.3 to 2.0 KHz |
| RIGHT TONE | 1.5 KHz | 0.3 to 2.0 KHz |

The ON DELAY function sets the time from the pressing of the START key to the transmission of tone-modulated RF signals to the headset 130. The ON TIME function sets the time during which the control unit will emit RF signals. The LEFT TONE and RIGHT TONE functions control the frequency of the signals transmitted to the headset.

After the ON DELAY time has expired, and until the ON TIME period expires, the control unit transmits a "hum" tone to the headset when the thresholds have not been exceeded, and a distinct signal or tone when one of the thresholds has been exceeded. The ON DELAY time encourages the golfer to establish a routine before executing the stroke and discourages rushing the stroke. During the ON DELAY time, peak readings are not captured, but ongoing sensor measurements are displayed on the LCD 172. Thereafter, until the ON TIME period expires, the control unit captures peak readings from each of the sensors and displays them on the LCD 172, as a percentage of a 100% calibration value, until they are reset by pressing the START/-STOP switch to initiate another measurement cycle. After two minutes of no START/STOP activity, the LCD is turned off to conserve power: The LCD 172 and the peak values can be viewed again later by pressing one of the UP/DOWN volume control keys 190–196.

The signals received by the control unit are sent to the mode switches 220, which are programmed by the CPU 160 to determine which calibration signals stored in the memory registers 212 and 214 will be compared with the received signals.

As will be understood by those skilled in the art, the attenuators 184 and 186, memory registers 212 and 214, the mode switches 220, and comparators 222 and 224 can be implemented in the CPU's software, stored in ROM 162, thereby reducing the number of individual components in the control unit 120. A number of commercially available microcontrollers contain built-in analog-to-digital and/or digital-to-analog converters and could be used to implement the control unit 120 with very few peripheral components.

Figure 2:
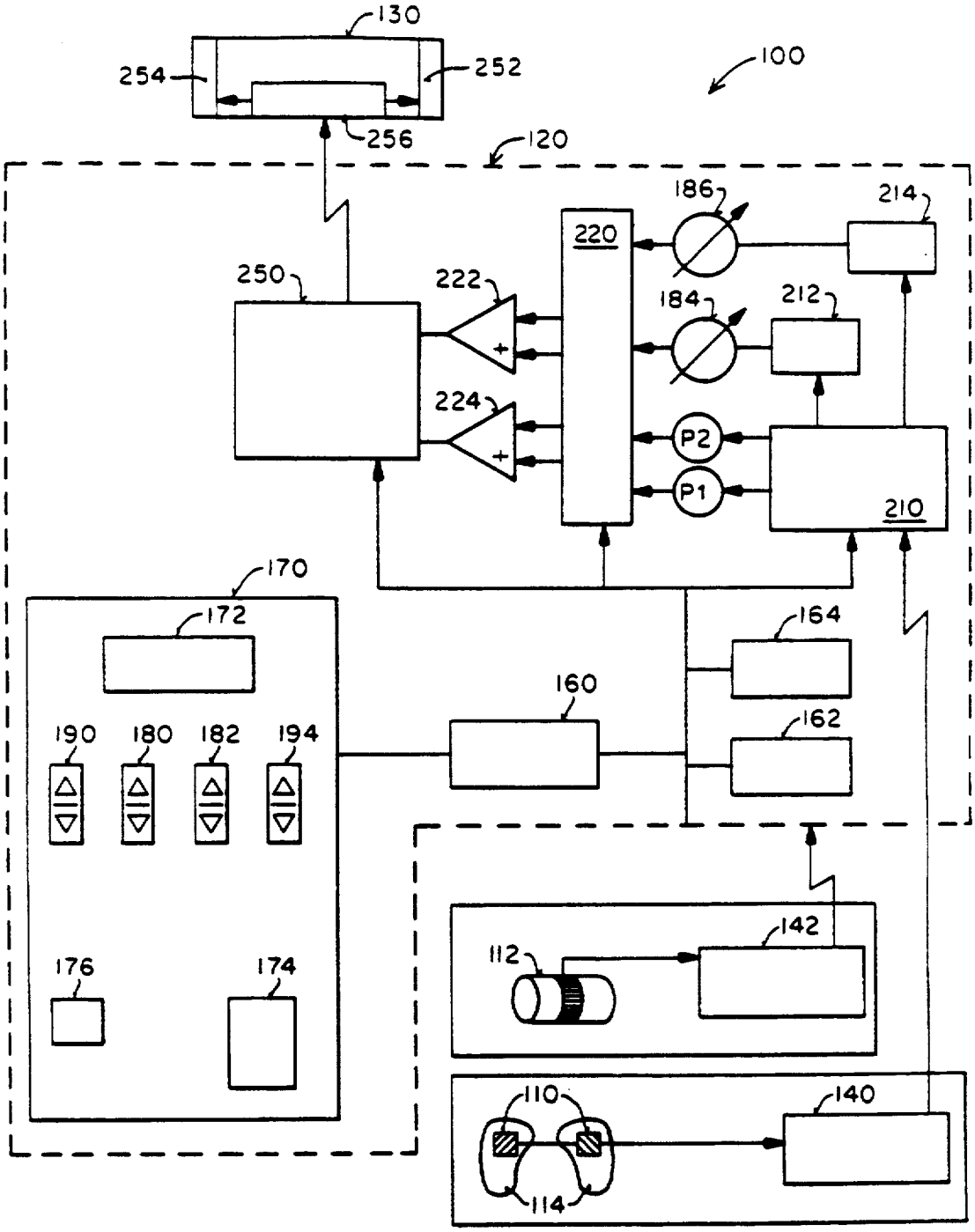
FIGS. 2–4 are block diagrams of circuitry employed in conjunction with weight and grip sensors as shown in FIG. 1.

FIG. 2 shows one attenuator coupled to each memory register, and two comparators 222 and 224. However, in many cases it is preferred that each of the memory registers is coupled to two attenuators, and that the control unit includes four comparators. This allows more than two user signals to be separately compared to respective reference values.

Figure 3:
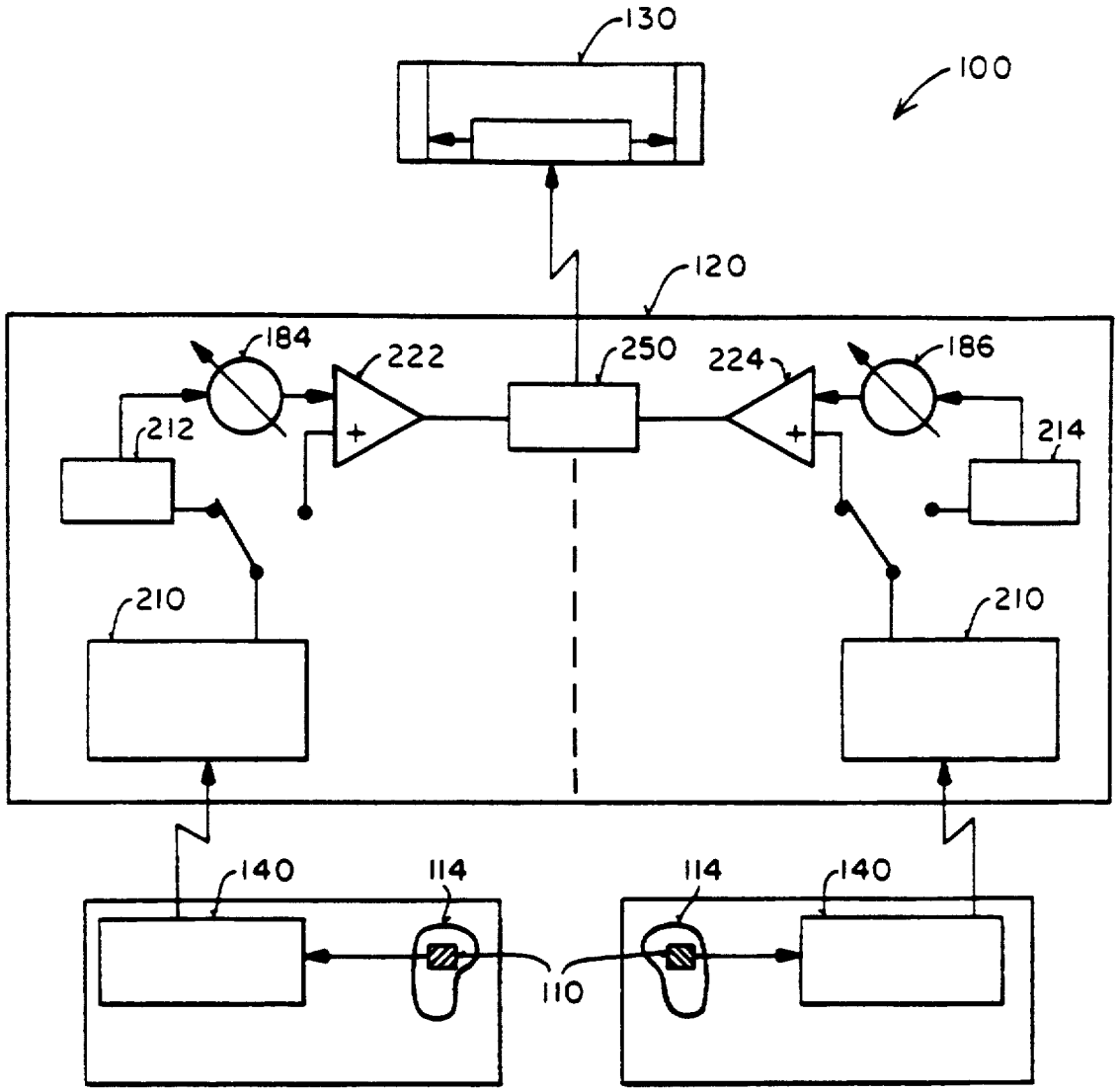

FIG. 3 shows the configuration of the control unit when it is running a training program based on input from the foot sensors (the "weight shift" program). Before the weight shift program can be used, the control unit must be calibrated. To do this, the START/-STOP key 174 is depressed for two seconds and then released. The user then stands on one foot. The peak response from that foot sensor is sent to the memory register 212. In a preferred embodiment, the peak response sent to the memory register is the highest value that is sustained for a predetermined time interval, for example 1 second; this eliminates spurious peak readings caused by jumping or stamping. The control unit sends a short tone to the headset to signal completion of this step. The other foot sensor is then calibrated in the same way. During the calibration procedure, the LCD displays "CALIBRATE PADS". The calibration signals are compared with preset values in the software to make sure that they are "reasonable" (e.g., representative of a weight between 34 and 160 kg).

The golfer sets the RIGHT threshold value by setting the RIGHT threshold control 180 for the percentage of his/her weight on the RIGHT foot sensor required to trigger a tone for the RIGHT audio channel of the headset. Similarly, the LEFT threshold control 182 is set to determine the LEFT threshold value. The CPU 160 then sets up attenuators 184 and 186 accordingly.

During normal use, when the START/STOP key is depressed, the weight or pressure signals from the RIGHT and LEFT foot sensors are continuously compared to the RIGHT and LEFT threshold settings after any programmed ON DELAY time. If the thresholds are exceeded, the control unit sends a RIGHT or LEFT channel tone modulated RF signal to the headset 130. The peak RIGHT and LEFT channel weight readings are held and displayed on the LCD 172. The training aid continues to operate in this manner until the ON TIME expires or the START/STOP key is depressed. Then the LCD 172 goes blank and the transmission of tones to the headset stops.

Figure 4:
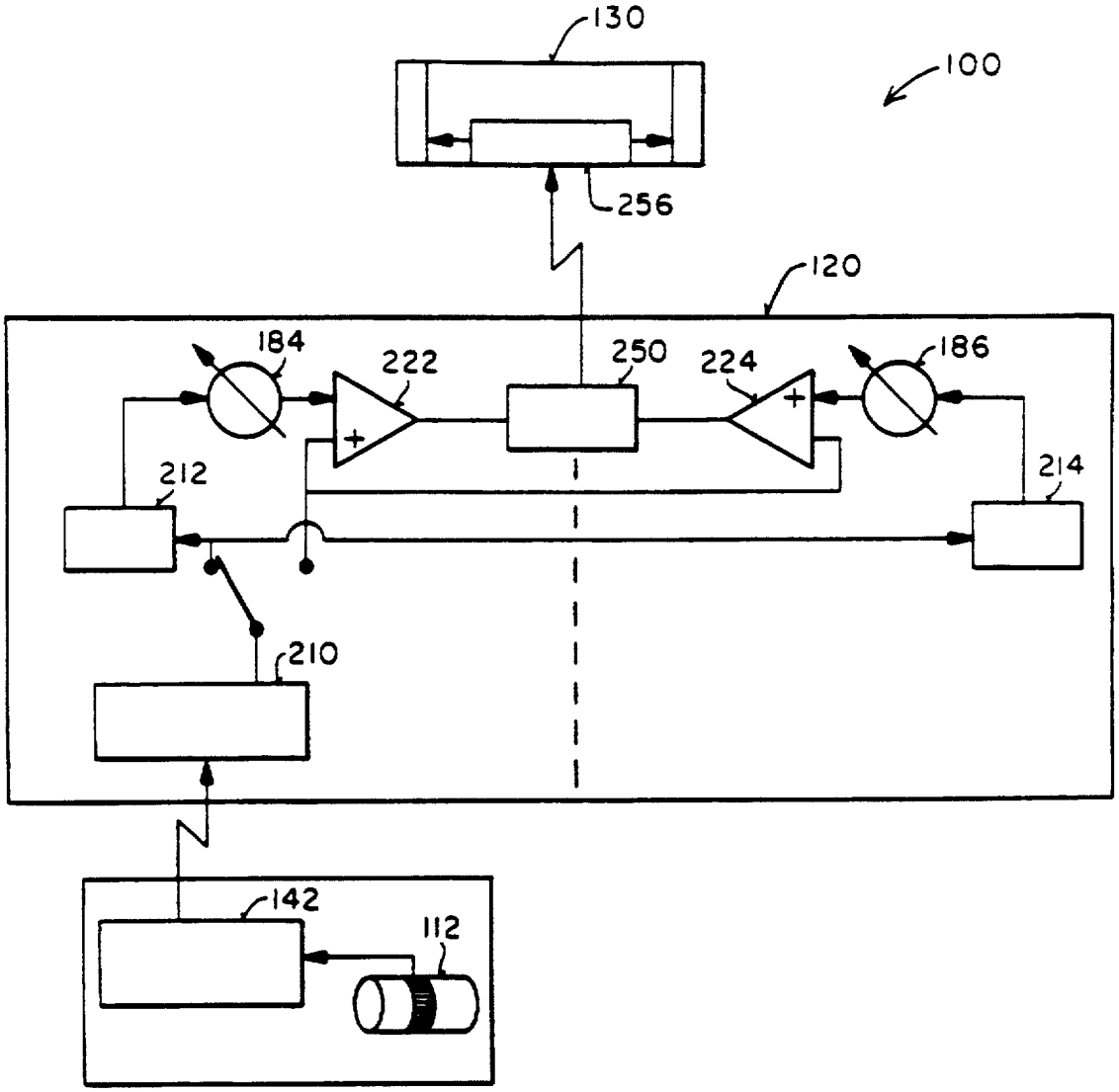

FIG. 4 shows the configuration of the control unit when it is running a training program based on input from the grip sensor (the "grip pressure" program). Before the grip pressure program can be used, the control unit must be calibrated. To do this, the START/-STOP key 174 is depressed for two seconds and then released. The golfer then applies maximum grip pressure to the grip sensor. The peak response from the grip sensor is sent to the control unit and stored in both memory registers 212 and 214. The control unit sends two short tones to the headset to signal completion of this step.

The LEFT threshold control 180 sets the threshold for low grip pressure on the grip sensor (as a percentage of the user's maximum grip pressure) and the RIGHT threshold control 182 sets the threshold for high grip pressure. Whenever the user's grip pressure falls outside the low and high threshold limits, the control unit sends a modulated RF signal to the headset. The training aid continues to operate in this manner until the ON TIME expires or the START/STOP key is depressed. Then the LCD 172 goes blank and the transmission of tones to the headset stops.

Alternatively, the control unit can be calibrated for this grip pressure program by sending the sensor reading while the user applies a "correct" grip pressure (i.e. one which is not too tight or too loose), and then using RIGHT and LEFT threshold controls to define a window of acceptable values above and below the calibrated grip pressure value.

Figure 7:
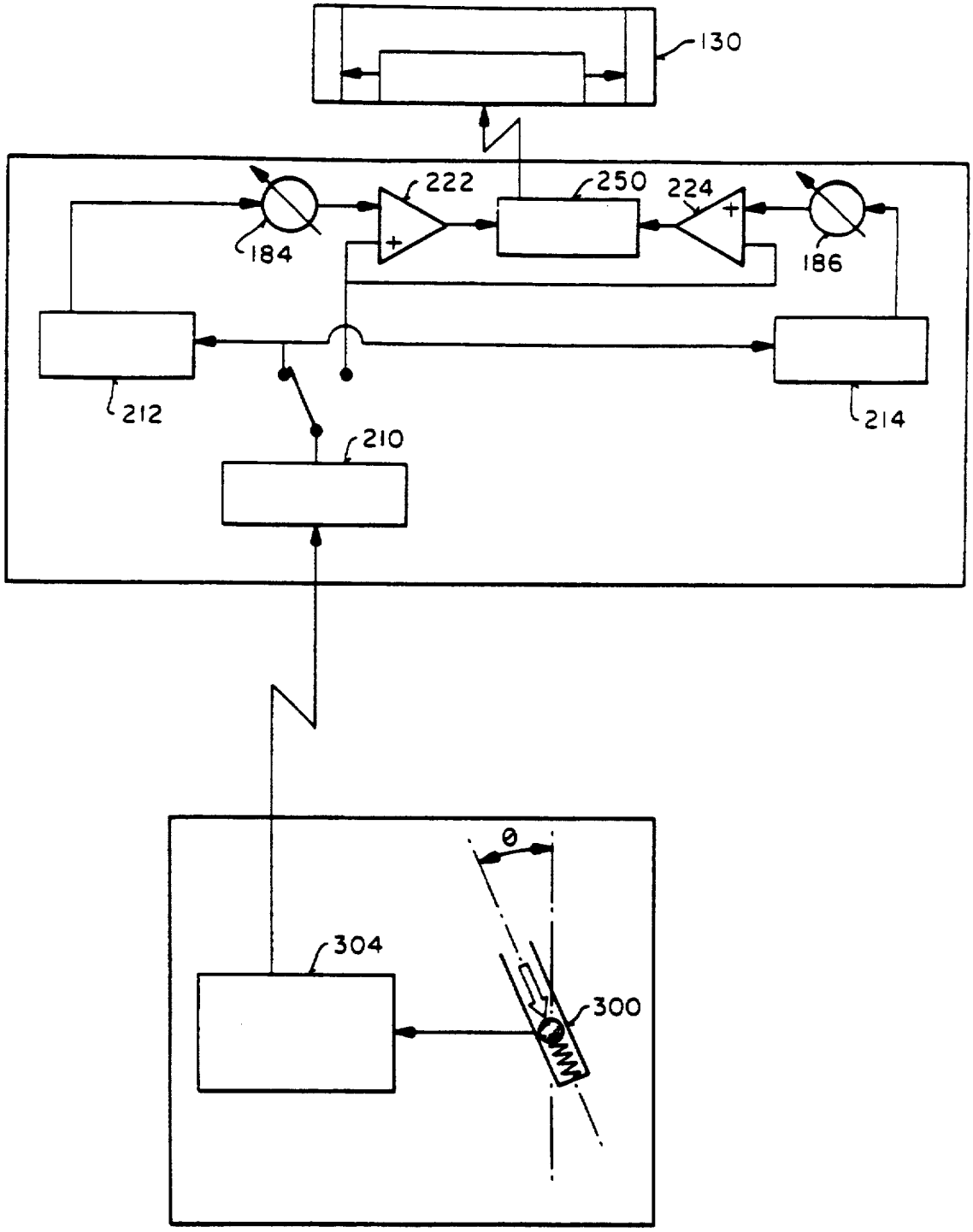
FIGS. 7 and 8 are block diagrams of circuitry employed in conjunction with the spine tilt and shoulder rotation sensors shown in FIGS. 5 and 6.

FIGS. 5 and 7 show a golfer equipped with a spinal tilt sensor and the configuration of the control unit when that sensor is being used for training. The spinal tilt sensor shown includes an accelerometer 300 and an encoder/transmitter 304. The accelerometer determines the angle of spinal tilt, $\theta$, measured from vertical, and provides a corresponding input to the encoder/transmitter 304. The encoder/transmitter 304 in turn transmits and appropriate signal to the receiver 210 located in the control unit. The control unit is shown here in the Calibration position, wherein the initial value of the player's spinal tilt is stored in memory registers 212–214. Attenuators 184 and 186 are then adjusted, using the LEFT and RIGHT threshold control keys 180 and 182, to provide the desired minimum and maximum tilt angles, thereby completing calibration.

During the player's swing, the sensor 300 will continuously sense the player's spinal tilt and send a corresponding signal to the control unit. The transmitted tilt value is compared by comparators 222 and 224 with the calibrated minimum and maximum tilt values, and the outputs from the comparators are fed to the transmitter 250, which sends signals to the headset 130. The headset's receiver generates tonal signals heard by the player. In a preferred embodiment, a tonal signal is sent to the player's left ear if the player's spinal tilt is less than the selected minimum and a tonal signal is sent to the player's right ear if his/her spinal tilt is more than the selected minimum.

Figure 8:
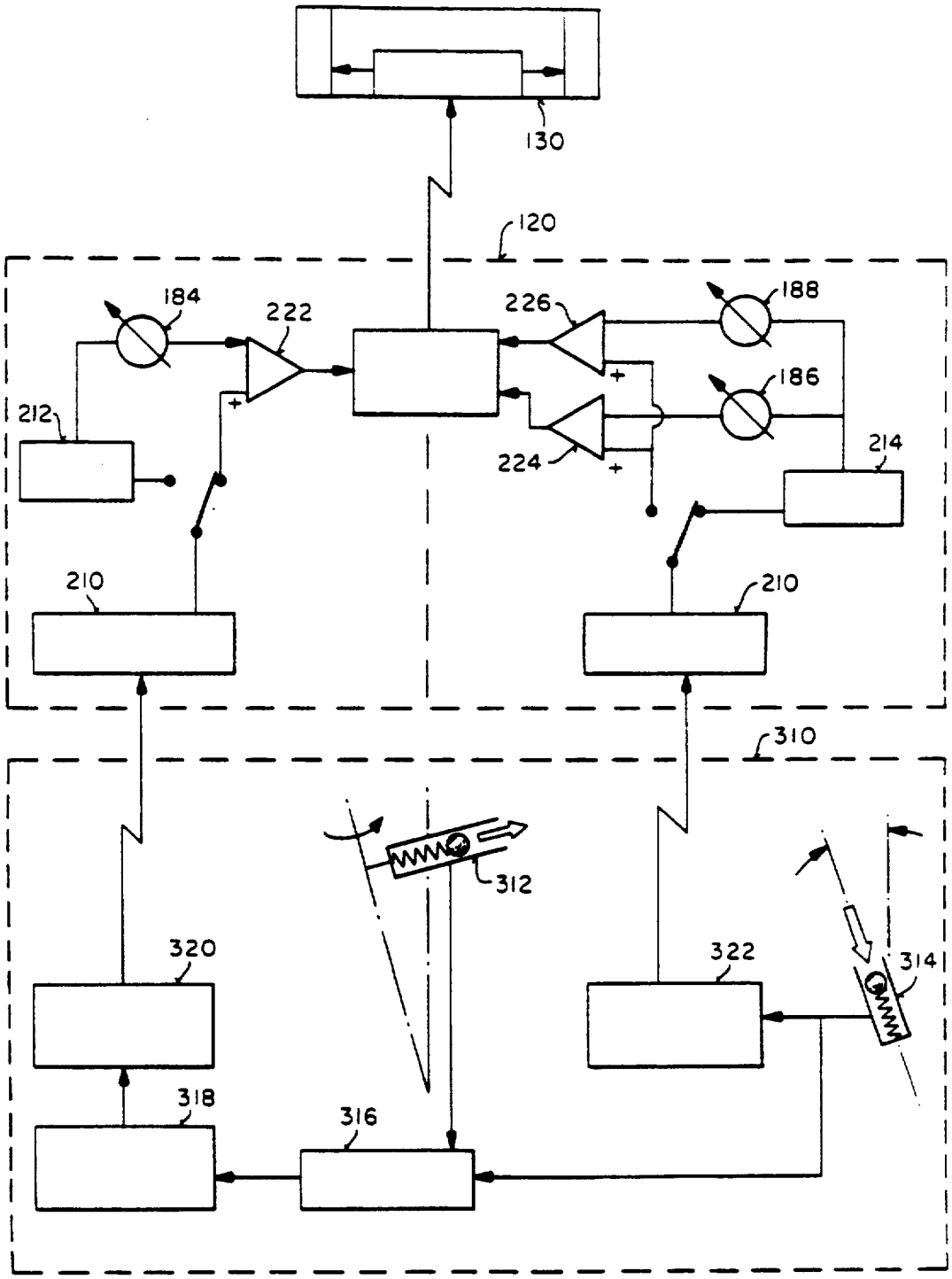

FIG. 6 shows a golfer equipped with a shoulder rotation sensor and FIG. 8 shows the configuration of the control unit when that sensor and a spinal tilt sensor are used together for training. The shoulder rotation sensor 310 contains two accelerometers 312 and 314; one is arranged to sense the normal component of rotation acceleration in a plane perpendicular to the player's spine and the other is used to measure any gravitational component of acceleration. The gravitational acceleration component is used to scale the rotational signal with multiplier circuit 316, and the resulting signal can then be double integrated with respect to time by integrator 318, providing a representation of the angular displacement of the player's shoulders. Both the spinal title value and the integrated shoulder rotation value are transmitted by encoder/transmitters 320 and 322, which transmit corresponding signals to the receivers 210 located in the control unit.

The control unit is shown here in the Calibration position, wherein the initial value of the player's shoulder rotational position is stored in memory register 212 and the player's initial spinal tilt is stored in memory register 214. Attenuators 184, 186 and 188 are then adjusted, using the LEFT and RIGHT threshold control keys 180 and 182, to provide the desired minimum shoulder rotation value for a proper backswing, and an allowed spinal title angle deviation range, thereby completing calibration.

During the player's swing, the sensor 310 will continuously sense the player's shoulder rotation and spinal tilt and send corresponding signals to the control unit. The transmitted shoulder rotation value is compared by comparator 222 with the calibrated minimum rotation value. During the backswing, prior to achieving the specified minimum rotational value, a first tone is generated in the headset, and after that rotation value is achieved, a second, different reinforcing tone is generated, letting the player know that he/she has achieved proper shoulder rotation. The transmitted spinal tilt is compared by comparators 224 and 226 with the allowed range of spinal tilt values, and a buzzing sound is generated by the headset if the player sways outside this range during the backswing.

In another embodiment, the two accelerometer measurements are sent without further processing to the control unit, and integrator 318 is replaced with a software integration routine. This has the advantage of using less hardware, and also making it easy to reset the computed shoulder rotation angle to zero at the beginning of each golf swing.

Preferably, the control unit can be operated in a number of "combined" modes of operation. For example, referring to FIG. 3, when the control unit is operated to provide both the weight shift and the grip pressure programs, the right foot sensor 114 and encoder/transmitter 140 depicted therein are replaced with the grip sensor 112 and encoder/transmitter 142 shown in FIG. 4. By making such a substitution, channel 1 of the control unit 120 will monitor the weight applied to the left foot and, simultaneously, channel 2 will monitor grip pressure. Each sensor is calibrated separately using the calibration methodology described above. In this combined mode, the training aid helps the player learn to maintain proper grip pressure during the downstroke.

Another example of a combined mode of operation is a combination of the spine tilt and weight shift programs. In such a combination, the right foot sensor in FIG. 3 could be replaced by the spinal tilt sensor of FIG. 7. In this mode of operation, the first sensor signals the pressure exerted by a portion of the user's body, while the second sensor signals the position of a portion of the user's body.

FIG. 8 shows the configuration of the control unit for a program in which two aspects of the player's body position (spinal tilt and shoulder rotation) are monitored simultaneously. A first sensor signal corresponding to the player's spinal tilt is compared by comparators 224 and 226 with a preselected range of values as determined by memory register 214 and attenuators 186 and 188, while the other channel of the control unit compares a shoulder rotation signal with a single preselected value stored in memory register 212, as adjusted by attenuator 184.

A simplified version of the equipment shown in FIGS. 1–8 makes use of wires in place of some or all of the transmitter/receiver combinations. While such wires may be somewhat inconvenient to the user, the advantages of such an embodiment include not only reduced cost but also the ability to have all the batteries for the system in the control unit.

Figure 9:
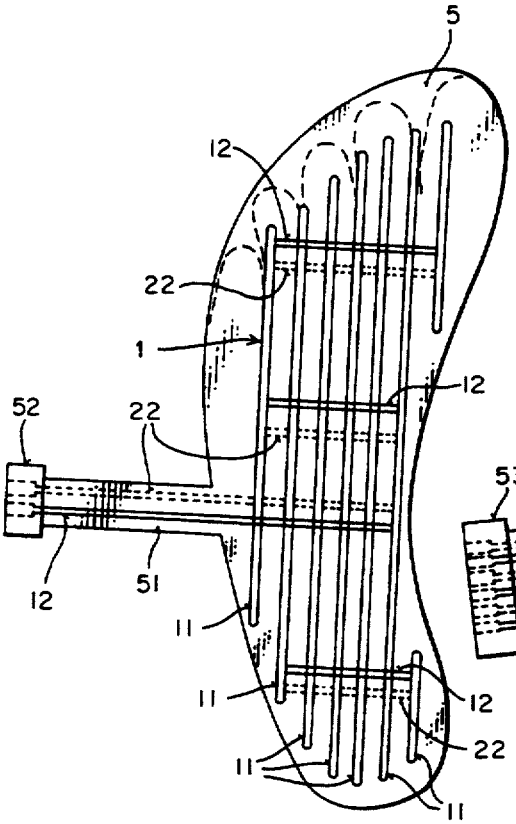
FIGS. 9 and 10 show shoe inserts including sensors.
Figure 10:
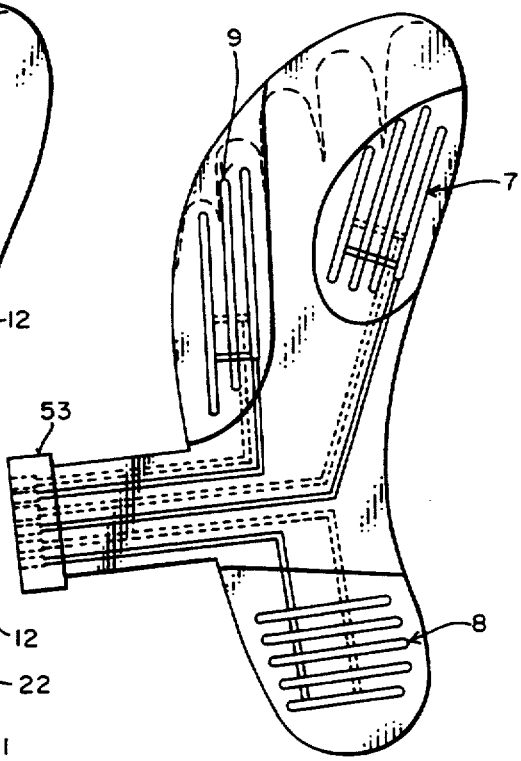

FIGS. 9 and 10 illustrate shoe inserts for the left foot of a right-handed golfer. In FIG. 9, there is a single pressure sensor 1 which extends under substantially all of the golfer's foot. The sensor includes an upper electrode 1 in the form of a plurality of longitudinal metallic strips 11 which are interconnected by transverse metallic bus bars 12. The electrodes 11 and bus bars 12 are screen printed onto the underside of a transparent flexible polymeric film 5 which is shaped like the sole of a shoe except for a tab 51 extending from the outside of the sole. One of the bus bars 12 extends along the tab 51. The sensor also includes a lower electrode in the form of a plurality of longitudinal metallic strips which lie directly under the strips 11 (and which are not, therefore, shown in FIG. 9) and which are interconnected by transverse metallic bus bars 22 which are shown by dotted lines in FIG. 9. The lower electrode and the bus bars 22 are screen printed onto the top side of a transparent flexible polymeric film which has the same shape as, and lies directly underneath, the film 5 (and which is not, therefore, shown in FIG. 9). Between the upper and lower electrodes are strips of a resistive ink comprising carbon black or a like conductive filler dispersed in a polymeric binder. These resistive strips coincide with the electrodes and are not, therefore, shown in FIG. 9. The resistive strips are formed by screen printing a resistive ink on top of one or both of the screen printed electrodes. The shoe insert is formed by laminating together the two polymeric films after the electrodes, bus bars, and resistive ink strips have been screen printed on them. The tab 51 and the bus bars which extend along the tab 51 are secured to a connector 52, to which an RF transmitter can be attached and clipped to the side of the golfer's shoe.

FIG. 10 is similar to FIG. 9 except that there are three separate relatively small sensors 7, 8 and 9 which are placed respectively under the ball, heel and leading edge of the foot, and which are separately connected to a connector 53 at the end of the tab.

Figure 11:
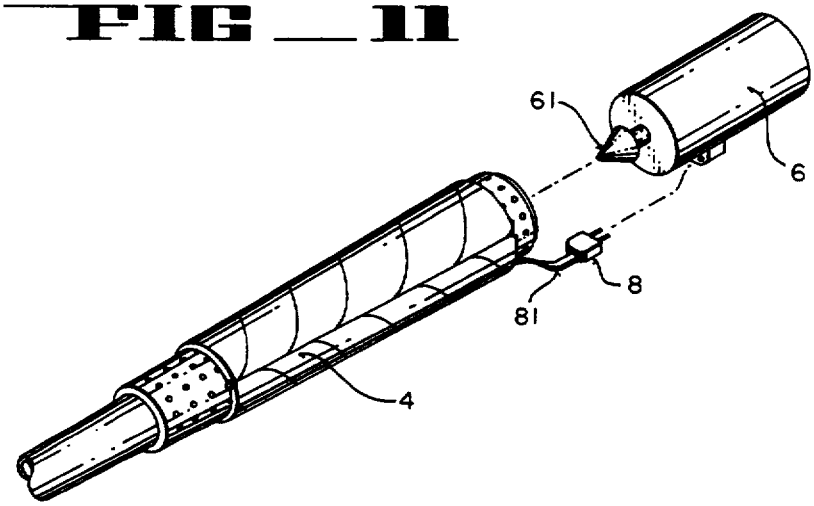
FIG. 11 shows a grip sensor secured to a golf club.

FIG. 11 illustrates the handle of a golf club which has a pressure sensor 4 wrapped around it and to which a transmitter 6 can be secured by means of post 61 which fits into a hole (not shown) in the end of the golf club. Connector 8 and associated wires 81 enable the output of the sensor to be communicated to the transmitter.

What is claimed is:

1. A method of training a user to move in a desired movement pattern which results in an object being thrown or kicked by the user or being struck by a piece of sports equipment which the user grips and swings, which method comprises (1) placing a sensor at a preselected location adjacent to the user, which sensor, when the user moves in an actual movement pattern similar to the desired movement pattern, can, continuously throughout the movement pattern, (i) sense changes in a user factor which are characteristic of the actual movement pattern and (ii) generate user signals corresponding to said changes;

(2) placing a comparator at a location where a function of the user signals generated by the sensor can be communicated to the comparator, which comparator, when the user moves in an actual movement pattern, can, continuously throughout the movement pattern, determine whether a function of the user signal is above or below a preselected and adjustable reference value;

(3) placing a signal generator at a location where (i) results of the comparison made by the comparator can be communicated to the signal generator, continuously throughout the movement pattern, and (ii) audible signals generated by the signal generator can be communicated to the user;

(4) causing the user to move in an actual movement pattern similar to the desired movement pattern;

(5) continuously throughout the movement pattern, causing the sensor to generate user signals which correspond to changes in the user factor sensed by the sensor;

(6) continuously throughout the movement pattern, communicating a function of the user signals to the comparator;

(7) continuously throughout the movement pattern, causing the comparator to determine whether a function of the user signals is above or below the reference value;

(8) continuously throughout the movement pattern, communicating the results of the determination made by the comparator to the signal generator;

(9) causing the signal generator to generate audible training signals which undergo a distinct change when said function of the user signals crosses the reference value; and

(10) communicating the audible training signals to the user;

steps (4), (5), (6), (7), (8), (9) and (10) being carried out substantially simultaneously, so that the user senses, during the actual movement pattern, training signals which represent a relationship between the actual movement pattern and the desired movement pattern.

2. A method according to claim 1 which comprises the steps of:

causing the user to adopt a desired starting position prior to step (4), causing the signal generator to generate a starting signal after the user has adopted the desired starting position, and ensuring that the signal generator does not generate training signals before expiry of a preselected delay period after the starting signal.

3. A method according to claim 1 wherein (i) the method makes use of two spaced-apart sensors, each of which generates distinct user signals, (ii) the comparator compares a function of each of the distinct user signals with a respective reference value, (iii) the signal generator generates distinct training signals which represent the results of the respective comparisons, and (iv) the distinct training signals are communicated separately to the user.

4. A method according to claim 1 wherein (i) the method makes use of two spaced-apart sensors, each of which generates distinct user signals, and (ii) the comparator makes a comparison between a function of one of the distinct user signals and a reference value which is a function of the other distinct user signals.

5. A method according to claim 1 wherein the reference value is a function of the user signals at an earlier time during the actual movement.

6. A method according to claim 1 wherein (i) the method makes use of a single sensor which is placed under one of the user's feet and senses the force applied to said single sensor by the user's weight, and (ii) the training signal represents the results of comparing a function of the user signals generated by said single sensor and a reference value.

7. A method according to claim 1 wherein (i) the method makes use of two spaced-apart sensors, (ii) one of the sensors is placed under one part of one of the user's feet and senses the force applied to said sensor by the user's weight, and (iii) the other sensor is placed under another part of the same one of the user's feet and senses the force applied to said other sensor by the user's weight.

8. A method according to claim 1 wherein (i) the sensor is placed between a substrate and at least one of user's hands, and senses the grip pressure applied by the user to the substrate, and (ii) the user signals change continuously in response to changes in the grip pressure.

9. A method according to claim 1 wherein (i) the sensor is placed between a substrate and at least one of the user's hands, and senses the grip pressure applied by the user to the substrate, and (ii) the reference signal is a function of the maximum grip pressure which the user can apply to the substrate.

10. A method according to claim 1 wherein (i) the sensor is one which can be calibrated relative to a fixed point, direction or plane and which, after being so calibrated, can generate user signals which represent the relationship between the sensor and the fixed point, direction or plane; and (ii) the sensor is calibrated relative to a fixed point, direction or plane before steps (4), (5), (6), (7), (8), (9) and (10).

11. A method according to claim 1 wherein the sensor, the comparator and the signal generator are carried by the user during the actual movement pattern.

12. A method according to claim 1 wherein the user grips a piece of sports equipment and is trained to swing that piece of equipment to strike a ball.

13. A method according to claim 12 wherein a golfer is trained to swing a golf club.

14. A method of training a user to move in a desired movement pattern, which method comprises (1) placing a sensor at a preselected location adjacent to the user, which sensor, when the user moves in an actual movement pattern similar to the desired movement pattern, can, continuously throughout the movement pattern, (i) sense changes in a user factor which are characteristic of the actual movement pattern and (ii) generate user signals corresponding to said changes;

(2) placing a comparator at a location where a function of the user signals generated by the sensor can be communicated to the comparator, which comparator, when the user moves in an actual movement pattern, can, continuously throughout the movement pattern, determine whether a function of the user signals is above or below a preselected and adjustable reference value;

(3) placing a signal generator at a location where (i) results of the comparison made by the comparator can be communicated to the signal generator, continuously throughout the movement pattern, and (ii) audible signals generated by the signal generator can be communicated to the user;

(4) causing the user to move in an actual movement pattern similar to the desired movement pattern;

(5) continuously throughout the movement pattern, causing the sensor to generate user signals which correspond to changes in the user factor sensed by the sensor;

(6) continuously throughout the movement pattern, communicating a function of the user signals to the comparator;

(7) continuously throughout the movement pattern, causing the comparator to determine whether a function of the user signals is above or below the reference value;

(8) continuously throughout the movement pattern, communicating the results of the determination made by the comparator to the signal generator;

(9) causing the signal generator to generate audible training signals which undergo a distinct change when said function of the user signals crosses the reference value; and

(10) communicating the audible training signals to the user;

steps (4), (5), (6), (7), (8), (9) and (10) being carried out substantially simultaneously, so that the user senses, during the actual movement pattern, training signals which represent a relationship between the actual movement pattern and the desired movement pattern; and the method having at least one of the following characteristics (A) to (J)

(A) the method comprises the steps of:

causing the user to adopt a desired starting position prior to step (4), causing the signal generator to generate a starting signal after the user has adopted the desired starting position, and ensuring that the signal generator does not generate training signals before expiry of a preselected delay period after the starting signal;

(B) (i) the method makes use of two spaced-apart sensors, each of which generates distinct user signals, (ii) the comparator compares a function of each of the distinct user signals with a respective reference value, (iii) the signal generator generates distinct training signals which represent the results of the respective comparisons, and (iv) the distinct training signals are communicated separately to the user;

(C) (i) the method makes use of two spaced-apart sensors, each of which generates distinct user signals, and (ii) the comparator makes a comparison between a function of one of the distinct user signals and a reference value which is a function of the other distinct user signals;

(D) the reference value is a function of the user signals at an earlier time during the actual movement;

(E) (i) the method makes use of a single sensor which is placed under one of the user's feet and senses the force applied to said single sensor by the user's weight, and (ii) the training signal represents the results of comparing a function of the user signals generated by said single sensor and a reference value;

(F) (i) the method makes use of two spaced-apart sensors, (ii) one of the sensors is placed under a first part of one of the user's feet and senses the force applied to said sensor by the first part of the user's foot, and (iii) the other sensor is placed under a second part of the same one of the user's feet and senses the force applied to said other sensor by the second part of the user's foot;

(G) (i) the sensor is placed between a substrate and at least one of user's hands, and senses the grip pressure applied by the user to the substrate, and (ii) the user signals change continuously in response to changes in the grip pressure;

(H) (i) the sensor is placed between a substrate and at least one of the user's hands, and senses the grip pressure applied by the user to the substrate, and (ii) the reference value is a function of the maximum grip pressure which the use can apply to the substrate;

(I) (i) the sensor is one which can be calibrated relative to a fixed point, direction or plane and which, after being so calibrated, can generate user signals which represent the relationship between the sensor and the fixed point, direction or plane; and (ii) the sensor is calibrated relative to a fixed point, direction or plane before steps (4), (5), (6), (7), (8), (9) and (10); and (J) the sensor, the comparator and the signal generator, and any other equipment needed to carry out the method, are carried by the user during the actual movement pattern.

* * * * *